US008284974B2

(12) United States Patent
Pander et al.

(10) Patent No.: US 8,284,974 B2
(45) Date of Patent: Oct. 9, 2012

(54) HEARING AID

(75) Inventors: Aeldrik Pander, Den Haag (NL); Michel Martin Marie Havenith, Zoetermeer (NL); Marcus Johannes Aloysius Kaal, Amsterdam (NL)

(73) Assignee: Exsilent Research B.V., Amsterdam (NL)

( * ) Notice: Subject to any disclaimer, the term of this patent is extended or adjusted under 35 U.S.C. 154(b) by 946 days.

(21) Appl. No.: 12/097,240

(22) PCT Filed: Dec. 12, 2006

(86) PCT No.: PCT/NL2006/000634

§ 371 (c)(1),
(2), (4) Date: Oct. 7, 2008

(87) PCT Pub. No.: WO2007/069889

PCT Pub. Date: Jun. 21, 2007

(65) Prior Publication Data

US 2009/0316940 A1 Dec. 24, 2009

(30) Foreign Application Priority Data

Dec. 12, 2005 (NL) ..... 1030649

(51) Int. Cl.
*H04R 25/00* (2006.01)
*H04R 25/02* (2006.01)

(52) U.S. Cl. ..... 381/328; 381/325; 381/322; 381/382

(58) Field of Classification Search ..... 381/328
See application file for complete search history.

(56) References Cited

U.S. PATENT DOCUMENTS

| | | | | |
|---|---|---|---|---|
| 4,532,649 | A | 7/1985 | Bellafiore | |
| 4,672,672 | A * | 6/1987 | Eggert et al. | 381/324 |
| 5,535,282 | A * | 7/1996 | Luca | 381/328 |
| 5,799,095 | A * | 8/1998 | Hanright | 381/312 |
| 6,456,720 | B1 * | 9/2002 | Brimhall et al. | 381/324 |
| 6,671,381 | B1 * | 12/2003 | Lux-Wellenhof | 381/325 |
| 6,766,030 | B1 * | 7/2004 | Chojar | 381/322 |
| 2004/0071306 | A1 * | 4/2004 | Kufner | 381/323 |
| 2005/0123163 | A1 | 6/2005 | Oliveira | |

FOREIGN PATENT DOCUMENTS

| | | | |
|---|---|---|---|
| DE | 29703150 | U1 | 4/1997 |
| EP | 0196366 | A2 | 10/1986 |
| EP | 1389034 | A | 2/2004 |

(Continued)

OTHER PUBLICATIONS

International Preliminary Report on Patentability, cited in PCT/NL2006/000634 on Apr. 4, 2008.

*Primary Examiner* — Jerome Jackson, Jr.
(74) *Attorney, Agent, or Firm* — Kilpatrick Townsend & Stockton LLP

(57) ABSTRACT

A hearing aid comprises a microphone on a proximal side of a device housing and a loudspeaker which via a transmission channel is in open communication with a sound-emitting opening of the device. A sound processing device serves to generate sound received by the microphone to the loudspeaker in amplified form. The device housing is provided on a distal side with an optionally sealed battery chamber for receiving a battery therein. The transmission channel is at least almost wholly separated from the microphone acoustically in order to prevent acoustic feedback. The battery chamber comprises ventilation means for the purpose of increasing the lifespan of the battery.

16 Claims, 2 Drawing Sheets

FOREIGN PATENT DOCUMENTS

| | | | |
|---|---|---|---|
| KR | 20040073410 | A | 8/2004 |
| WO | WO 2006/001611 | A | 10/1986 |
| WO | WO 93/25053 | A | 12/1993 |
| WO | WO 97/41710 | A | 11/1997 |
| WO | WO 01/41503 | A | 6/2001 |
| WO | WO 01/43497 | A | 6/2001 |

* cited by examiner

HEARING AID

This application is a National Stage of International Application No. PCT/NL2006/000634, filed Dec. 12, 2006, and which claims the benefit of Netherlands Patent Application No. 1030649, filed on Dec. 12, 2005, the disclosure of both applications are incorporated herein by reference in their entirety.

The present invention relates to a hearing aid which is adapted to be received at least almost fully in an auditory canal of a user in at least locally fitting manner, comprising a device housing having on a proximal side a microphone, a loudspeaker which via at least one transmission channel is in open communication with a sound-emitting opening of the device, a battery chamber for receiving a battery therein, and comprising a sound processing device for generating sound received by the microphone to the loudspeaker in at least partly processed manner.

Such a hearing aid is for instance known from International patent application WO 01/41503. The hearing aid described herein comprises two parts of a device housing releasably connected to each other and is provided on a proximal side with a microphone. The device further comprises a loudspeaker for generating the sound received by the microphone, after it has been amplified and/or processed by the sound processing device, to a sound-emitting opening situated on a distal outer end of the device. The two device parts enclose a cavity which forms, distally of the loudspeaker, both a transmission channel between the loudspeaker and the sound-emitting opening and a battery chamber. The battery chamber provides space for a battery which electrically powers the device during operation. An outer shell of the two parts is herein shaped to the size of the individual anatomy of the auditory canal of the user and fits closely therein. This hearing aid is particularly intended for placing deep inside the auditory canal so that no parts thereof protrude or are visible outside the ear.

Partially due to the relatively short distance in such a hearing aid between the proximal side with the microphone on the one hand and the distal end with the sound-emitting opening on the other, there is a very real danger of so-called acoustic feedback. Sound generated by the loudspeaker via the sound-emitting opening is here picked up by the microphone and then, amplified or processed, once again generated via the loudspeaker and picked up again by the microphone, and so on, this eventually resulting in an extremely irritating whistle or screeching tone drowning everything out. It goes without saying that such feedback is highly irritating to the user.

The present invention has for its object, among others, to provide a hearing aid of the type described in the preamble, in which the chance of such acoustic feedback of sound is significantly countered.

In order to achieve the intended object, a device of the type stated in the preamble has the feature according to the invention that the battery chamber extends at least partly distally from the loudspeaker and that acoustically the at least one transmission channel in the device is at least almost wholly separated from the microphone. This acoustic separation is herein present both internally, through the device, and externally, around the device, and prevents sound emitted by the loudspeaker from being able to escape directly from the transmission channel to the microphone. Owing to the precise fit of the device in the auditory canal of the user, no acoustic path, or hardly any, is provided here along an outer wall of the device from the distal side to the proximal side thereof, while an acoustic path from the transmission channel to the microphone is also at least almost wholly precluded in the device itself. The danger of acoustic feedback is thus limited to a significant extent.

In a preferred embodiment the hearing aid according to the invention has the feature that the battery chamber is in open communication via at least one ventilation channel with a ventilation opening on the proximal side of the device housing, and that acoustically the transmission channel is at least almost wholly separated from the battery chamber. Because the transmission channel is at least almost wholly separated from the battery chamber acoustically, the output sound is prevented from being able to penetrate into the battery chamber. The battery chamber can thus comprise a ventilation provision and be in open communication with the ambient air on the proximal, microphone side of the device without any danger of acoustic feedback. In practice this has been found to enhance the operation and lifespan of the battery to a significant extent.

A further embodiment of the hearing aid according to the invention has the feature that the battery chamber is provided with a re-placeable cover which at least almost wholly seals the battery chamber acoustically. The intended acoustic sealing of the battery chamber, which nevertheless allows the battery to be replaced at the end of its lifespan if desired, is thus provided in relatively simple manner.

An optimal operation of the hearing aid is often only achieved in practice by individually adjusting a processing characteristic of the sound processing device to the individual hearing impairment of the user. For this purpose the sound processing device has to be individually programmed. For the known hearing aid this entails the device having to be removed from the ear to make room for a special reference device. The original device must then be adjusted on the basis of a thereby determined processing characteristic. For this purpose the device is taken apart and placed in a programming device designed specially designed for this purpose to then enable loading of the desired processing characteristic therein. This is not only particularly laborious and time-consuming, but must also be carried out by a trained audiologist. In a further respect the present invention has the further object, among others, to provide a hearing aid which can be electronically adjusted in considerably simpler manner.

For this purpose the present invention also provides a hearing aid comprising a device housing having on a proximal side a microphone, a loudspeaker, which is in open communication via at least one transmission channel with a sound-emitting opening of the device, an optionally sealed battery chamber for receiving a battery therein, and comprising a programmable sound processing device for generating sound received by the microphone to the loudspeaker in at least partially amplified form, which is characterized for this purpose according to the invention in that the device housing comprises in the proximal part a programming connector which is coupled to a programming input of the sound processing device, which programming connector is able and adapted to connect operatively to a complementary connector of programming means. Owing to the programming connector the hearing aid can be adjusted and fine-tuned at all times in relatively simple manner by directly connecting a suitable programming device thereto. The hearing aid does not have to be taken apart or even removed from the ear for this purpose, and only a limited amount of specialist knowledge or equipment is otherwise required for this purpose. The user can listen in continuously during the adjustment of an individual processing characteristic, so that feedback from the user is always possible.

With a view to extending the lifespan of the battery, a further embodiment of a hearing aid according to the invention has the feature that the device housing also comprises a switch on the proximal side. Using the switch the device can for instance be switched off at night so as to avoid unnecessary energy consumption. It is possible here to opt for a switch which directly opens or closes the power supply to the electrical components of the device. However, in a preferred embodiment the device according to the invention has the feature that the switch comprises an electronic or magnetic pulse switch. Touching such a pulse switch results only in a switch signal, in the form of for instance a switch flank or switch pulse, on the basis of which the device switches on or off or is set in a specific operating mode, this subject to a specific program code loaded into the device. This significantly increases the versatility of the device.

A further object of the invention is to simplify the assembly and manufacture of a hearing aid. For this purpose a hearing aid comprising a microphone on a proximal side, a loudspeaker on a distal side, a battery chamber for receiving a battery therein and a programmable sound processing device for generating sound received by the microphone to the loudspeaker in at least partially processed form, has the feature according to the invention that at least the microphone and the loudspeaker, together with electronic wiring mutually connecting the components, are arranged on a shared carrier and are arranged together therewith in the device as pre-mounted assembly, and that vibration-absorbing means are provided between the microphone and the loudspeaker. By thus accommodating the electronic components beforehand on a flexible carrier together with necessary conducting connections, not only is the final assembly of the whole simplified but the components are also fixed at the correct mutual distance. It is thus furthermore possible to already carry out a full check of the correct operation of the device in an intermediate phase of the assembly. The vibration-absorbing means herein prevent vibrations being transmitted from the one acoustic transducer, such as the microphone or the loudspeaker, to the other and thus suppress acoustic feedback therebetween. A particular embodiment of the hearing aid herein has the feature according to the invention that the vibration-absorbing means comprise a loop-shaped extension of the carrier.

A further particular embodiment of the hearing aid has the feature according to the invention that the device housing is at least partly enclosed with a fitting body, an outer wall of which is adapted to lie in at least locally sealing manner in an auditory canal of the user, and that the fitting body comprises the sound-emitting opening. The device housing can herein be manufactured serially as a standard component, while the fitting body is optionally individually made to size in order to obtain the desired fit in the ear. This results in a significant efficiency advantage from a logistics and manufacturing viewpoint. Because the two components are mutually releasable the device remains accessible for maintenance, repair and inspection.

A determined embodiment of the hearing aid according to the invention has the more particular feature that the fitting body comprises a sleeve with a cavity which is open on at least one side and in which the device housing is releasably placed, and that an outer wall of the device housing lies sealingly against an inner wall of the cavity. The device housing can herein be pushed into respectively pulled out of the cavity of the fitting body relatively easily. A further preferred embodiment of the device herein has the feature according to the invention that the outer wall of the device housing and the inner wall of the cavity are mutually provided with a peripheral rib or an at least almost complementary peripheral groove, which are able and adapted to co-act in mutually sealing manner. The groove and rib herein ensure not only the desired mutual acoustic sealing but also a precise, determined mutual axial positioning and fixing of the two parts. A projection and complementary cavity can optionally be provided here in order to also achieve a determined fixation in radial direction around a longitudinal axis.

A further particular embodiment of the hearing aid is characterized in that a groove in the outer wall of the device housing between the loudspeaker and the sound-emitting opening at least partly comprises the transmission channel. Such a groove can be arranged or provided relatively easily and is finally sealed by the fitting body which fits thereover. Instead or in addition, the transmission channel can also extend in the fitting body. A further particular embodiment of the hearing aid according to the invention has for this purpose the feature that a groove in an inner wall of the fitting body between the loudspeaker and the sound-emitting opening at least partly comprises the transmission channel.

In order to enable problem-free removal of the hearing aid from the ear as desired, a further embodiment of the hearing aid according to the invention has the feature that the fitting body comprises a pull member which extends beyond the proximal side of the device housing. The hearing aid can thus be gripped on the proximal side at the pull member and thereby pulled wholly out of the ear. Such a pull member can be provided in various ways, for instance as a cord or string. A further preferred embodiment of the hearing aid however has the feature according to the invention that the pull member comprises a monolithic tab which extends as an integral part from the fitting body. Such an integral tab is manufactured as one part together with the fitting body, and therefore requires no additional assembly or manufacturing steps.

In order to avoid an acoustic return path of output sound to the proximal side of the device, a precise fit of the device in the auditory canal is very important. Such a fit can be obtained by custom fitting, wherein a precise contact print of the auditory canal is made in order to individually model the device to size for the user on the basis thereof. A preferred embodiment of the hearing aid according to the invention however has the feature that a peripheral wall of the fitting body is at least locally flexible and adapted and able to adjust itself to a natural anatomy of the auditory canal, and more particularly that the peripheral wall of the fitting body comprises one or more flexible fins which extend all around and are able and adapted to lie close-fittingly in the auditory canal of the user. By thus making use of a self-adjusting fitting body, it is possible to suffice with only a limited number of standard sizes thereof, wherein the material itself provides for the desired close-fitting connection to the auditory canal. Not only is the intended return sealing thus obtained, the relatively soft material of the fitting body is moreover found to contribute significantly to the wearer comfort of the device.

The operation of a hearing aid is often found in practice to deteriorate eventually. It has been found that this is often the result of a whole or partial blockage of the transmission channel. Such a blockage is usually the result of cerumen, a yellow, greasy substance which is secreted by sebaceous glands in the external auditory canal and is also referred to as earwax, and which unavoidably accumulates on the distal side of the hearing aid. It is important that the relatively vulnerable loudspeaker remains free of cerumen. With a view hereto, a further preferred embodiment of the hearing aid according to the invention has the feature that the transmission channel between the loudspeaker and the sound-emitting opening comprises a buffer space for cerumen. Owing to such a buffer space cerumen can accumulate before reaching the loudspeaker, and this increases the undisturbed period of operation. A further particular embodiment of the hearing aid has the feature according to the invention that the transmission channel between the loudspeaker and the sound-emitting opening comprises a curve. Such a curved, at least not straight, transmission channel likewise forms a barrier to cerumen in the direction of the loudspeaker, and can be applied in addition to or instead of said buffer space. In the case of a possible blockage of the curve or when the buffer space is full, both can be cleaned relatively easily without any danger of damaging vulnerable parts of the hearing aid.

A further preferred embodiment of the hearing aid has the feature according to the invention that the sound-emitting opening opens into a recess in a distal end of the device. Such a recessed position of the sound-emitting opening provides an additional barrier to a distal accumulation of cerumen, so that the sound-emitting opening remains open longer. In order to also enhance a free passage of sound from the sound-emitting opening in the unfortunate case of an auditory canal which is curved to greater or lesser extent at the position of the sound-emitting opening, a further particular embodiment of the hearing aid according to the invention has the feature that the recess comprises at least one groove in the distal end, and more particularly that the at least one groove extends, at least in projection, in at least two directions. In at least almost all cases the reach of such a groove or assembly of grooves will hereby provide an (under)passage along which the output sound of the device can escape, particularly if the groove extends in multiple directions.

The invention will now be further elucidated on the basis of an exemplary embodiment and an accompanying drawing. In the drawing.

The figures are for the most part schematic and not drawn to scale. Some dimensions in particular can be exaggerated to a greater or lesser extent for the sake of clarity. Corresponding parts are designated in the figures with the same reference numerals.

Figure 1:
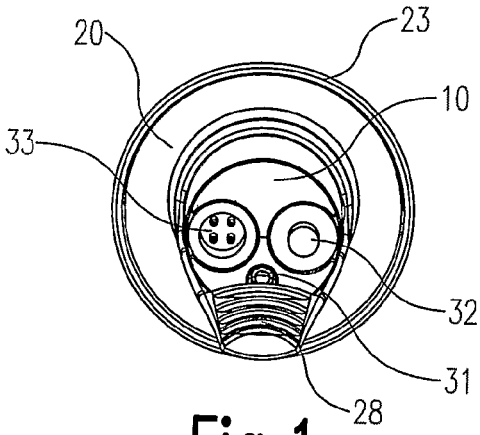
FIG. 1 shows a proximal view of an exemplary embodiment of a hearing aid according to the invention.

The hearing aid of FIG. 1 comprises a device housing 10 in which all active components of the device are accommodated. The device housing comprises as such a microphone 31, a programming connector 33 and an electronic or magnetic pulse switch 32 on a proximal side 11. Device housing 10 is form-retaining and manufactured from a relatively hard plastic, such as in this case ABS, and forms with the electronic components accommodated therein a standard module which can be manufactured serially.

For an optimal fit in an auditory canal of a user the device housing 10 is mounted releasably on its distal side in a fitting body 20 which provides the contact with the auditory canal. Device housing 10 herein protrudes into a central cavity 21 of fitting body 20, see also FIGS. 2 and 3, which thus extends as a sleeve round device housing 10. Other than device housing 10, fitting body 20 is manufactured from a soft, relatively flexible plastic, such as for instance a silicone or other synthetic rubber, so that it can adjust itself in comfortable and efficient manner to the natural anatomy of the auditory canal. A biocompatible plastic is preferably used for fitting body 20.

On an outer wall 22 fitting body 20 comprises a number of relatively thin, flexible fins 23 which further contribute toward the ability of the whole to adjust to the shape of the auditory canal and to ensure an adequate acoustic sealing. Fins 23 furthermore limit the physical contact between fitting body 20 with device housing 10 therein and the inner wall of the auditory canal, whereby so-called occlusion phenomena are also reduced. Not only is a close fit of the device in the ear thus obtained, the relatively soft fitting body thus also contributes toward the user comfort of the device.

The fitting body is also a serially produced, standard article which need thus be supplied in a limited number of sizes so as to provide a satisfactory fit for diverse users. Within the scope of the invention it is otherwise also possible to apply a flexible or firmer, form-retaining fitting body, which is specifically made to measure and formed individually to size so as to thus fit as precisely as possible onto the auditory canal of the user. The shown flexible fitting body does however have the advantage that such an individual dimensioning can be dispensed with, and use can be made instead of only a limited number of standard sizes, which will in practice satisfactorily cover the great majority of cases.

Owing to the close fit of fitting body 20 in the ear there is substantially no acoustic path along outer wall 21 of the device from distal side 12 to proximal side 11 of the device. In order to also prevent such an acoustic return path between device housing 10 and fitting body 20, the device housing comprises over the whole periphery of an outer wall thereof a peripheral groove 13 which falls close-fittingly into a complementary rib 24 in an inner wall 25 of cavity 21 in fitting body 20. By placing device housing 10 into fitting body 20 the groove 13 eventually snaps over rib 24. Groove 13 and rib 24 thus provide an acoustic sealing between the two parts 10,20, and moreover provide a precise mutual fixation and positioning. If desired, groove 13 can conversely be provided in an inner wall of the fitting body and the rib on the outer wall of the device housing, whereby mutatis mutandis the same mutual sealing and axial fixing of the two parts can be ensured.

Figure 2:
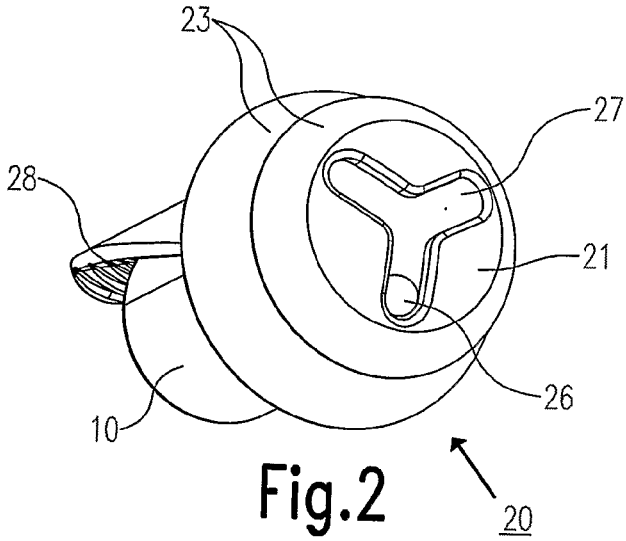
FIG. 2 shows a distal view of the hearing aid of FIG. 1.
Figure 3:
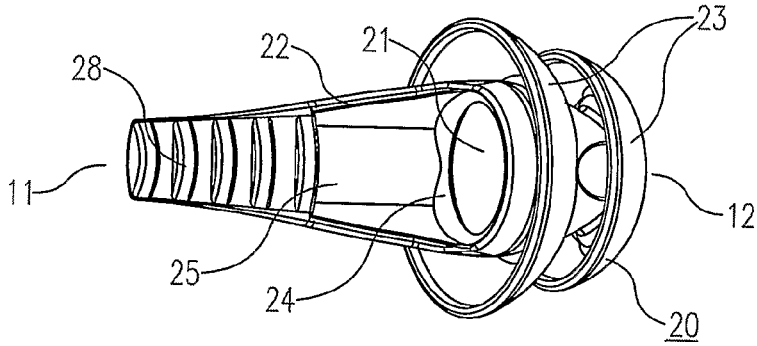
FIG. 3 shows a view of the fitting body of the hearing aid of FIG. 1.

On a distal end 12, see FIG. 2, the fitting body comprises an out-of-centre sound-emitting opening 26 which opens into a recess 27 in outer wall 21. For this purpose a star-shaped groove 27 in which sound-emitting opening 26 debouches is provided at this position in the outer wall. A cross or star with four or even more branches or one or more mutually connected rings can optionally also be used as recess 27. Such a cross or other groove shape extending in different, optionally orthogonal directions, with sound-emitting opening 26 in a bottom thereof, provides a free (under)passage from which the sound can escape from sound-emitting opening 26, even in the unfortunate case of a strong local curving of the auditory canal.

In order to enable problem-free removal of the device from the ear, fitting body 20 is provided with a pull member 28 in the form of a monolithic tab which is formed thereon as integral part and which extends beyond the proximal side 11 of device housing 10. The device can be grasped by this tab 28 to thus integrally remove fitting body 20 with device housing 10 therein. Instead of or in addition to such a pull-tab, it is otherwise possible to provide another pull member, such as for instance a pull-cord, on device housing 10 with which the device can be removed from the ear.

Figure 4:
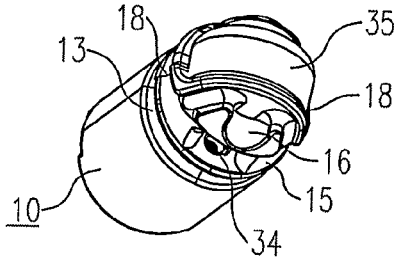
FIG. 4 shows a distal view of the device housing of the hearing aid of FIG. 1.
Figure 5:
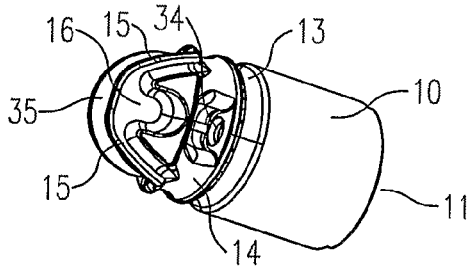
FIG. 5 shows a further view of the device housing of FIG. 4.

A loudspeaker 34 of the device is in open communication via an internal transmission channel 14-16 with sound-emitting opening 26 for the purpose of transmitting processed and/or amplified sound thereto during operation. This is further shown in the cut-away view of FIGS. 4 and 5. In this case transmission channel 14 comprises two curved legs 15 through which sound is carried from loudspeaker 34 to sound-emitting opening 26. The curve 15 provides a barrier for encroaching cerumen, which could enter via sound-emitting opening 26. A buffer space 16 is in addition provided in the transmission channel between loudspeaker 34 and sound-emitting opening 26, in this case just in front of opening 26, in which possible cerumen can moreover accumulate before penetrating further, which could otherwise eventually result in malfunctioning of the device, for instance because loudspeaker 34 is fouled or the transmission channel becomes completely blocked. Both buffer space 16 and transmission channel 14,15 are relatively easy to clean, making use of common cleaning agents. A cerumen protection 15,16 is thus provided in the transmission channel, which significantly enhances the useful life and operation of the device.

Apart from being accommodated in the outer wall of device housing 10, the transmission channel can otherwise also be wholly or partially accommodated in fitting body 20. For this purpose a corresponding groove can for instance be provided in the inner wall of cavity 21 of fitting body 20 at the appropriate location between loudspeaker 34 and sound-emitting opening 26. A cerumen protection as described above can in that case also be wholly or partially integrated into such a groove in the inner wall of the fitting body.

Figure 6:
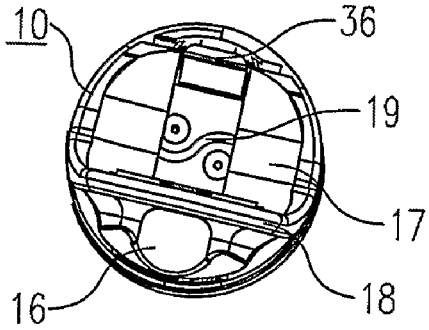
FIG. 6 shows a further distal view of the device housing of FIG. 4 without battery.

Also situated on the distal side of device housing 10 is a battery chamber 17, see also FIG. 6, with a button battery 35 therein. Transmission channel 14-16 is fully separated acoustically from battery chamber 17 by a dividing wall 18 which, in assembled state, connects close-fittingly to flexible inner wall 25 of cavity 21 in fitting body 20. Furthermore, a replaceable cover, not shown here, can optionally be placed over battery 35, which cover fully seals battery chamber 17 acoustically from transmission channel 14-16, even without fitting body 20. On an opposite side the transmission channel 14-16 is acoustically bounded by groove 13, which also seals acoustically all around on the inner wall of the fitting body. Transmission channel 14-16 is thus at least almost wholly insulated acoustically from the remaining part of device housing 10, and thereby in particular from microphone 31, so as to prevent acoustic feedback.

In order to ensure an adequate ventilation of battery 35, battery chamber 17 is in open communication with fresh outside air via a ventilation channel 19 provided for this purpose which debouches with a ventilation opening adjacently of microphone 31 on the proximal side 11 of device housing 10.

Programming means provided for the purpose with which a personal processing characteristic can be loaded into a sound processing device 37 of the hearing aid can be connected to programming connector 33. The device can thus be adjusted to the individual requirement of the user. Owing to connector 33 this characteristic can be adjusted and fine-tuned at all times without having to take the device apart or even remove it from the ear. During operation microphone 31 receives sound on the proximal side and transmits it to a signal input of sound processing device 37. Sound processing device 37 amplifies and processes the input signal on the basis of the processing characteristic programmed therein, and generates this as output signal to loudspeaker 34. From the loudspeaker the sound signal is carried via transmission channel 14-16 to sound-emitting opening 26 of the device, where it enters the auditory canal and is perceived by the auditory organs of the user in amplified and possibly processed form. Since there is no open acoustic connection from this distal side of the device to the proximal side, acoustic feedback of sound is effectively countered.

Figure 7:
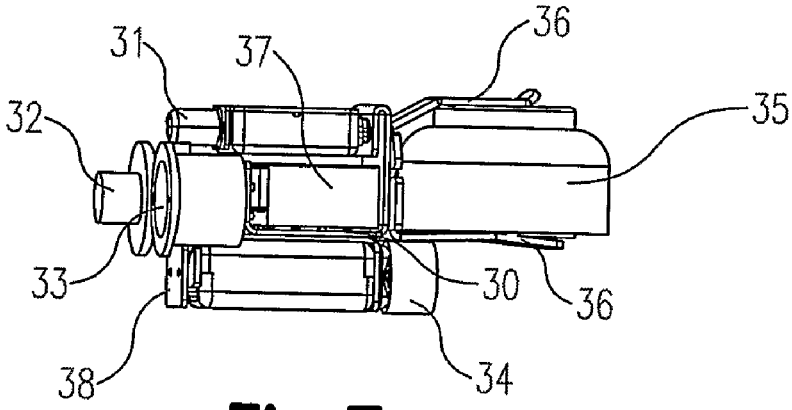
FIG. 7 shows a side view of the internal parts of the device housing of FIG. 4.
Figure 8:
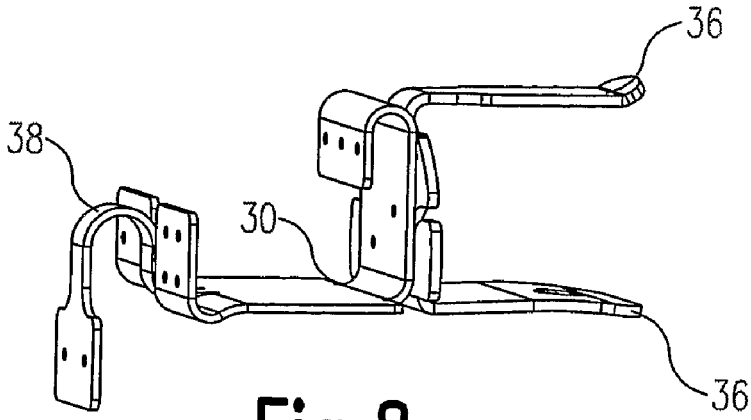
FIG. 8 shows a side view of a flexible carrier of the internal parts of FIG. 6.

For a simplified assembly of the device all electronic components, such as microphone 31, programming connector 33, switch 32, sound processing device 37, loudspeaker 34 and a set of battery contacts 36 of the device, are pre-mounted on a slightly flexible carrier 30, see FIGS. 7 and 8. In this example use is made for the carrier of a polyimide film commercially available under the brand name Kapton®, although other materials are also suitable in this respect within the scope of the invention. In addition, carrier 30 comprises the conductor tracks necessary for connecting the different components to each other. The components are thus fixed precisely relative to each other and can be pretested for correct operation before the whole is provided with a device housing 10. Loudspeaker 34 is herein not mounted directly against the other part of the components but via a loop-shaped extension 38 of carrier 30, which moreover thus provides a certain vibration and shock-absorbing capacity. It has been found that direct mounting of a vibrating transducer, such as here loudspeaker 34, on a more or less rigid carrier 30 can result in vibrations being transmitted to the other components, and in particular to another transducer, such as microphone 31. Vibration-absorbing means, such as here loop-shaped extension 38, suppress this phenomenon and thus prevent the otherwise occurring risk of acoustic feedback between the various components 31,34 on carrier 30.

Carrier 30 is accommodated in folded state in housing 10, wherein the various components are thus each positioned at the correct position. Device housing 10 can herein be cast around carrier 30 with the components thereon, or be placed therearound as two or more separate shell parts. A sealing ring or sealing sleeve of flexible material (not further shown) round the loudspeaker or a loudspeaker housing provides an adequate acoustic sealing from the device housing. Exceptionally efficient and reliable manufacture is thus possible.

Although the invention has been further elucidated above with reference to only a single exemplary embodiment, it will be apparent that the invention is by no means limited thereto. On the contrary, many more variations and embodiments are possible within the scope of the invention.

The invention claimed is:

1. Hearing aid to be wearable substantially completely in an auditory canal of a user, comprising:

a device housing which comprises a microphone at a proximal side thereof;

a loudspeaker which is in open communication with a sound-emitting opening at a distal side via at least one sound transmission channel;

a battery chamber for receiving a battery therein; and a sound processing device for processing a sound signal received by said microphone and sending the sound signal to said loudspeaker in an at least partly processed form, wherein said at least one transmission channel and said microphone being acoustically at least substantially completely separated from one another within said device, said device housing is releaseably accommodated in a fitting body having a close fit at least locally in the auditory canal of the user, said at least one transmission channel extends at least partly in a groove formed in either or both of an inner wall of said fitting body and an outer wall of said device housing, and said fitting body comprises said sound-emitting opening.

2. Hearing aid as claimed in claim 1, wherein said battery chamber is in open communication via at least one ventilation channel with a ventilation opening on said proximal side of said device housing, and in that said at least one transmission channel and said battery chamber are at least substantially completely separated acoustically from one another.

3. Hearing aid as claimed in claim 1, wherein said fitting body comprises a sleeve with a cavity which is open on at least one side to receive said device housing in a releasable manner, an outer wall of said device housing lying sealingly against an inner wall of said sleeve.

4. Hearing aid as claimed in claim 3 wherein said outer wall of said device housing and said inner wall of said cavity are provided with either one of a peripheral rib and an at least substantially complementary peripheral groove, which cooperate in mutually sealing manner.

5. Hearing aid as claimed in claim 1, wherein said fitting body comprises a pull member which extends beyond said proximal side of said device housing.

6. Hearing aid as claimed in claim 5, wherein said pull member comprises a monolithic tab which extends as an integral part from said fitting body.

7. Hearing aid as claimed in claim 1, wherein a peripheral wall of said fitting body is at least locally flexible and is adapted and able to adjust itself to a natural anatomy of the auditory canal.

8. Hearing aid as claimed in claim 7, wherein said peripheral wall of said fitting body comprises one or more flexible fins which extend all around and are able and adapted to lie close-fittingly in the auditory canal of the user.

9. Hearing aid as claimed in claim 1, wherein said transmission channel between said loudspeaker and said sound-emitting opening comprises a buffer space for cerumen.

10. Hearing aid to be wearable substantially completely in an auditory canal of a user, comprising: a device housing which comprises a microphone at a proximal side thereof;

a loudspeaker which is in open communication with a sound-emitting opening at a distal side via at least one sound transmission channel;

a battery chamber for receiving a battery therein; and a sound processing device for processing a sound signal received by said microphone and sending the sound signal to said loudspeaker in an at least partly processed form, wherein said at least one transmission channel and said microphone being acoustically separated from one another within said device, said at least one transmission channel and said battery chamber being acoustically isolated from one another, said transmission channel between said loudspeaker and said sound-emitting opening comprises locally additional buffer space for collecting cerumen, and said device housing is releaseably accommodated in a fitting body having a close fit at least locally in the auditory canal of the user, and said at least one transmission channel extends between an inner wall of said fitting body and an outer wall of said device housing.

11. Hearing aid as claimed in claim 10, wherein said transmission channel between said loudspeaker and said sound-emitting opening comprises at least one curve.

12. Hearing aid as claimed in claim 10, wherein said sound-emitting opening opens into a recess in a distal end of said device.

13. Hearing aid as claimed in claim 12, wherein said recess comprises at least one groove in said distal end.

14. Hearing aid as claimed in claim 13, wherein said at least one groove extends, at least in projection, in different directions.

15. Hearing aid according to claim 10 wherein said sound processing device is programmable, and said device housing comprises at said proximal side a programming connector which is coupled to a programming input of said sound processing device, which programming connector is able and adapted to connect operatively to a complementary connector of programming means.

16. Hearing aid as claimed in claim 15, wherein said device housing comprises an electronic or magnetic pulse switch at said proximal side.

* * * * *